United States Patent [19]

Betterley

[11] 4,209,189

[45] Jun. 24, 1980

[54] SELF-WICKETING TICKET

[75] Inventor: James E. Betterley, Huntingdon Valley, Pa.

[73] Assignee: Globe Ticket Company, Horsham, Pa.

[21] Appl. No.: 955,419

[22] Filed: Oct. 27, 1978

[51] Int. Cl.[2] ..... G09F 3/10

[52] U.S. Cl. ..... 283/18; 40/2 R; 40/21 R

[58] Field of Search ..... 283/18–20; 40/2 R, 20 R, 20 A, 21 R, 21 C

[56] References Cited

U.S. PATENT DOCUMENTS

| | | | |
|---|---|---|---|
| 1,616,946 | 2/1927 | Behrman | 40/21 R |
| 2,799,104 | 7/1957 | Griesinger | 40/20 R |
| 3,130,509 | 4/1964 | Brooks | 40/21 R |
| 3,662,480 | 5/1972 | Gilson, Jr. et al. | 40/20 R |
| 3,933,560 | 1/1976 | Muttera | 40/20 A |

*Primary Examiner*—John McQuade

*Attorney, Agent, or Firm*—Harding, Earley & Follmer

[57] ABSTRACT

A self-wicketing ticket is provided by a tag, one side of which is coated with a pressure sensitive adhesive covered by a backing removable to expose the pressure sensitive adhesive. The tag is provided with a wicket providing means formed by a strip portion thereof having a reinforcing tape thereon to provide additional strength thereto.

7 Claims, 11 Drawing Figures

SELF-WICKETING TICKET

BACKGROUND AND SUMMARY OF THE INVENTION

The tickets used at ski areas to identify skiers (and in other similar applications) have been fastened to the skier's clothing by means of a steel wire which had a tag stapled to it. The purpose of the wicket is to provide a hanger which can be put through a portion of the skier's clothing, such as belt loop, button hole or zipper pull. The tag is fastened over the wicket to make a tamper detectible, non-switchable seal so that the ticket cannot be reused by taking it from the place of attachment on the original user and attaching it to another person's clothing.

However, the above-described wickets were not entirely satisfactory because they presented the danger of injury in case of a fall during which the sharp edges of the wicket could severely injure the skier. This led to the use of a pipe cleaner or fiber covered wire. More recently, plastic wickets have been introduced such as those shown and described in U.S. Pat. No. 3,933,560.

In my application, Ser. No. 771,908, filed Feb. 25, 1977, I have disclosed a self-wicketing ticket including a pressure sensitive tag provided with a wicket forming means provided by a strip portion of the same material as the tag. The tag of the present invention is an improvement over this tag in that it obviates the problem of providing a tamperproof ticket that is tamper detectible and cannot be transferred from person to person. In order to prevent re-use of a ticket of the indicated type, it is desirable to have a strong wicket and a somewhat weaker ticket. If the ticket is too strong, it can be pulled apart and put back together again without being torn so that this maneuver is not detectible and the ticket can be transferred from person to person.

The ticket construction of the present invention prevents such re-use by making the ticket portion of the tag of material such that, once applied, it would tear if it were taken apart, and, at the same time, by providing a wicket portion which is very strong. This is achieved by providing a reinforcing strip on the strip portion of the tag that forms the wicket means.

In accordance with another aspect of the invention, there is disclosed a novel method for making the ticket. To this end, the ticket is formed in a strip having a plurality of tickets in end-to-end relation by the steps of forming a pair of spaced apart parallel slits extending longitudinally and centrally of a strip of tag forming material having pressure sensitive adhesive on one side and a removable backing material adhered to the pressure sensitive adhesive, applying a strip of tape of reinforcing material in the area between the parallel slits and cutting said strip along a line extending longitudinally between said parallel slits, said cut extending through said reinforcing material, said tag forming material and said backing so as to form two strips of tickets in end-to-end relation.

The tickets of the present invention are superior to the prior art comparable tickets in that they are less expensive to manufacture, and are easy to attach onto a person's clothing in a minimum of time.

DETAILED DESCRIPTION OF THE PREFERRED EMBODIMENT

Figure 1:
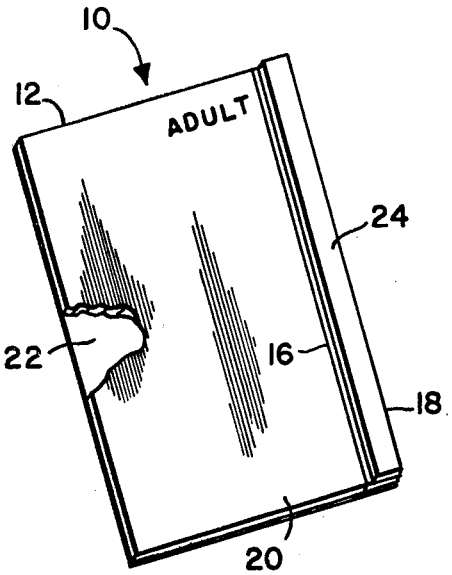
FIG. 1 is a view showing a ticket in accordance with the invention.

Referring to FIG. 1, there is shown a ticket 10 comprised of a rectangular tag 12 provided with a coating 14 of a pressure sensitive adhesive located throughout the bottom side of tag 12 as viewed in FIG. 1. Tag 12 is preferably made of a reasonably sturdy paper of a strength to resist tampering in the assembled condition of the ticket as will be described hereafter.

Tag 12 is provided with a slit 16 extending along and spaced from a side edge thereof. Slit 16 serves to define a wicket portion 18 of tag 12 on one side of slit 16 and a ticket portion 20 on the remaining portion of tag 12. The bottom sides of both the wicket portion 18 and the ticket portion 20 are covered with the pressure sensitive adhesive coating 14 and are in contact with a backing 22. The backing 22 and both the wicket portion 18 and the ticket portion 20 are manually separable from one another to expose the pressure sensitive adhesive coating 14.

The top side of ticket portion 20 is provided with a suitable marking, such as the word "ADULT" as shown in FIG. 1. In the case of a ski ticket, the ticket markings will generally indicate the name of the ski area and be provided with a suitable color coding.

In accordance with a novel feature of the invention, wicket portion 18 is provided with a reinforcing tape 24 adhered to the top side thereof as viewed in FIG. 1. The reinforcing tape 24 is made of a strong tape, such as "Mylar" or a filament type of tape, and increases the strength of wicket portion 18 to an amount such that it will function as a strong ticket wicket capable of withstanding the forces applied thereto in use. At the same time, ticket portion 20 is made of a material, such as a sturdy paper or the like, that is not too strong such that, once applied, it cannot be pulled apart and put back together without tearing. Instead, in order to pull ticket portion 20 apart after it is placed in a folded-over assembled condition (see FIG. 5), it will be necessary to tear the ticket. Thus, such tampering attempts will be detectible to the operator of the ski area or the like, and it will not be possible to transfer the ticket from person to person.

Figure 3:
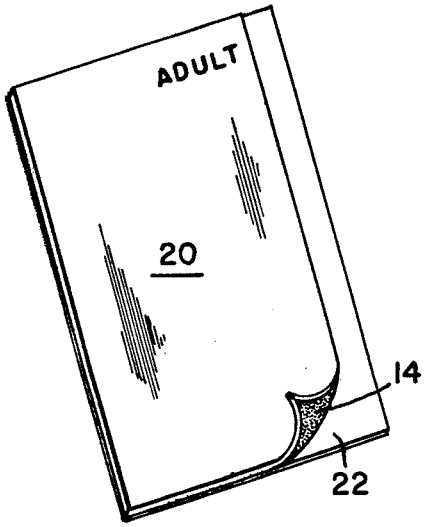
FIGS. 3, 4 and 5 are views showing the manner in which the ticket shown in FIG. 1 is attached to a zipper pull.
Figure 4:
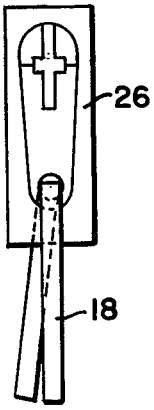
Figure 5:
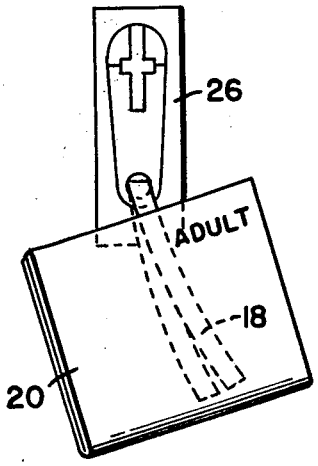

The method of attaching ticket 10 to an article of clothing is illustrated in FIGS. 3, 4 and 5. The first step in this method is to separate wicket portion 18 from the portion of the backing 22 therebeneath. After removal, wicket portion 18 is looped around a part of a skier's clothing such as the zipper pull 26 shown in FIG. 4. Preferably, parts of the pressure sensitive coating 14 of wicket portion 18 are pressed together to provide a tight grip and a secure loop in the zipper pull 26. This holds the wicket portion 18 in place in readiness for the next step.

Ticket portion 20 is then separated from backing 22 to expose the pressure sensitive coating 14 thereof. This is achieved by pulling the backing 22 and ticket portion 20 apart as is illustrated in FIG. 3, this maneuver generally being most easily initiated at a corner portion adjacent the removed wicket portion 18. The portion of backing 22 under the removed wicket portion provides a handle that can be used to separate the backing 22 and the ticket portion 20 as is illustrated in FIG. 3.

The final step in the method is to fold ticket portion 20 in half with opposed portions of the pressure sensitive coating enclosing wicket portion 18 therebetween. The final condition of the ticket is illustrated in FIG. 5 which shows the ticket attached to zipper pull 26. It is noted that in this assembled condition, there is an adhesive-to-adhesive contact between the exposed pressure sensitive coating portion of wicket portion 18 and opposed pressure sensitive coating portions of the folded ticket portion 20. This provides a very secure holding action between the wicket portion 18 and ticket portion 20.

Figure 6:
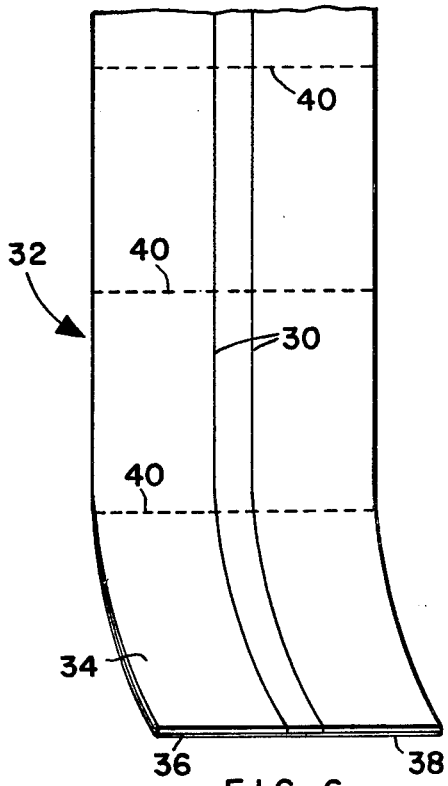
FIGS. 6 to 9 are views showing successive steps in the manufacture of a strip of the tickets shown in FIG. 1.

In accordance with another aspect of the invention, the tickets 10 are made as part of a ticket strip by a method illustrated in FIGS. 6 to 9. The first step of this method is illustrated in FIG. 6 and involves forming a pair of slits 30 in a strip 32 consisting of a tag forming material having a pressure sensitive adhesive coating 36 on the bottom side thereof and a backing material 38 adhered to the adhesive coating 36. The strip 32 is provided with transversely extending perforation lines 40 spaced apart equally and defining the ends of the tickets 10. As is conventional in the art, perforation lines 40 permit manual separation of a ticket 10 from the remainder of strip 32.

Slits 30 are formed in spaced apart parallel relation to extend longitudinally along the central portion of strip 32. In view of the high amount of accuracy required for the cutting of the slits 30 in tag forming material 34 without cutting into backing material 36, this step is performed by die cutting, a technique well known in the art and having the required accuracy. It is important that the slits 30 be cut to a depth limited to the tag forming material as will be apparent hereafter.

Figure 7:
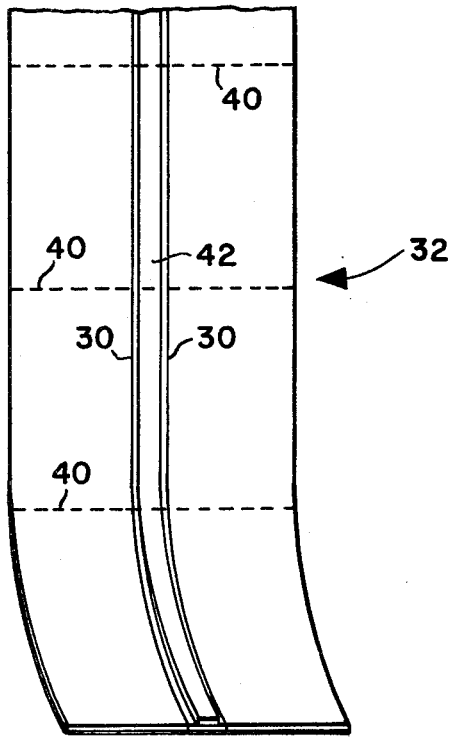

The next step in the method is to apply a strip of tape 42 of reinforcing material on the top of tag forming material 34 in the area between slits 30. This step is illustrated in FIG. 7 and it will be noted that tape 42 is centered between slits 30.

Figure 8:
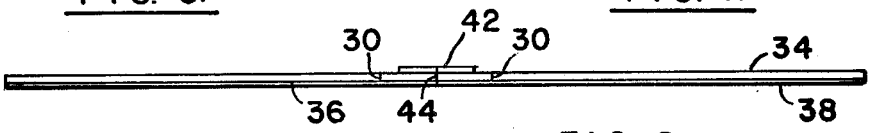

The final step in the method is to cut strip 32 along a line extending longitudinally between slits 30, this cut being indicated at 44 in FIG. 8. Cut 44 extends longitudinally along the center of strip 32 to divide the same in half into the two strips 46 and 48 shown in FIG. 9. Thus, cut 44 extends through reinforcing strip 42, tag forming material 34, and backing member 38. The cut 44 does not require the accuracy of a die cut and is performed by a slitter as is well known in the art.

Figure 9:
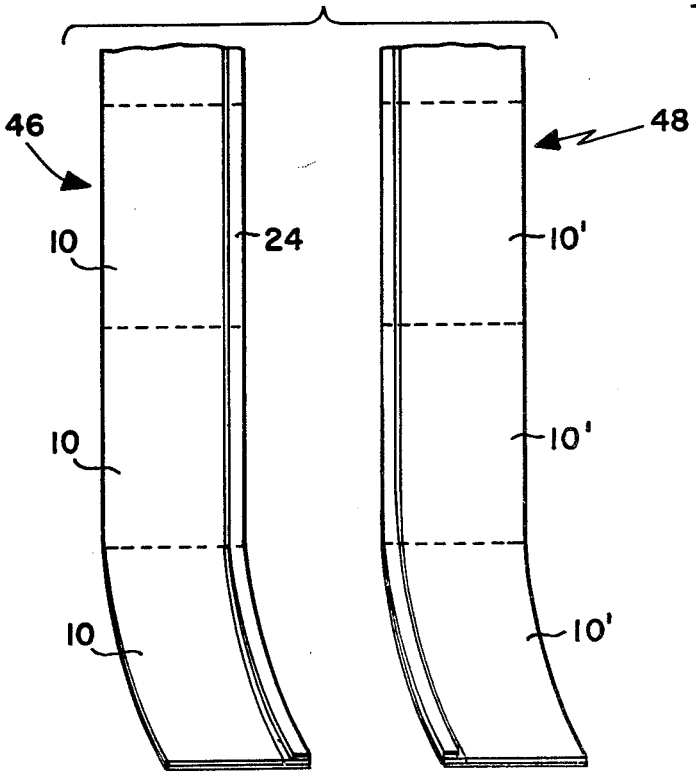

It will be noted that the ticket strip 46 on the left-hand side of FIG. 9 comprises a plurality of end-to-end tickets 10, of the type shown in FIG. 1. The ticket strip 48 on the right-hand side of FIG. 9 comprises a plurality of end-to-end tickets 10' which are construction wise like a mirror image of ticket 10 and will function in the same manner as described above with respect to tickets 10.

Figure 10:
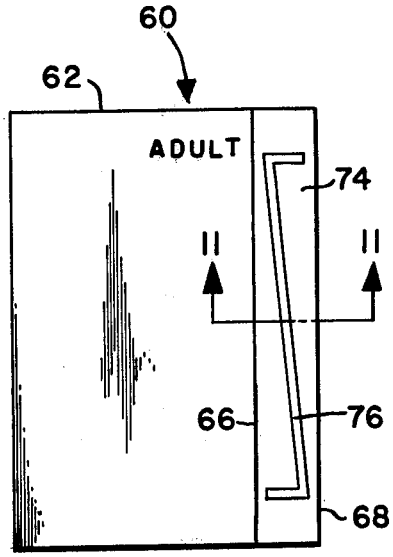
FIG. 10 is a view showing another ticket in accordance with the invention.
Figure 2:
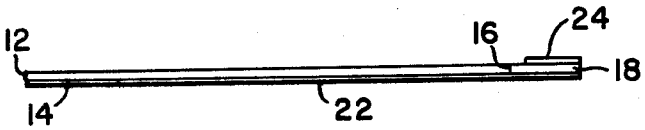
FIG. 2 is an enlarged fragmentary view showing an end of the ticket shown in FIG. 1.
Figure 11:
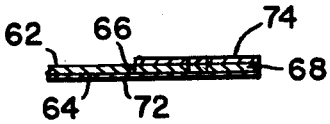
FIG. 11 is an enlarged sectional view taken on line 11—11 of FIG. 10.

In FIGS. 10 and 11 there is shown another ticket 60 in accordance with the invention. The essential difference between ticket 60 and the previously described ticket 10 is that the former has a wicket providing means in the form of a pop-out portion. To this end, ticket 60 comprises a rectangular tag 62 of strong paper provided with a coating 64 of a pressure sensitive adhesive on the bottom side thereof as viewed in FIG. 10. Tag 62 is provided with a slit 66 extending along and spaced from a side edge thereof dividing tag 62 into a wicket portion 68 and a ticket portion, both of which are manually separable from a backing 72 covering the bottom sides thereof. Wicket portion 68 is provided with a reinforcing tape 74 adhered to the top side thereof as viewed in FIG. 10.

Wicket portion 68 is provided with a pop-out wicket 76 formed by a cut in tag 62 entending around the periphery of said pop-out wicket 76. The cut defining pop-out wicket 76 is a die cut extending through both the reinforcing tape 72 and the wicket portion 68 as is shown in FIG. 11 and is in a configuration to define a wicket having a Z-like shape. As is conventional in pop-out constructions, wicket 76 is separable from backing 72 as a unit.

By the construction shown in FIGS. 10 and 11 wherein the ticket is provided with a pop-out wicket, it will be apparent that the shape of the wicket 76 may take various forms as is desired. It will be apparent that in all other essential respects, the ticket 60 is similar to the ticket 10 described hereinbefore. In use, the ticket portion 70 performs the same function as ticket portion 20 of ticket 10 and the pop-out wicket 76 performs the same function as wicket portion 18.

It is to be noted that the drawings are illustrative only and the tickets may vary in size to suit a particular application. For example, a ticket 10 to be attached to a skier's clothing will have a wicket portion 18 having a width of about one-eighth inch.

I claim:

1. A self-wicketing ticket comprising:

a tag, one surface of which is coated with a pressure sensitive adhesive, a backing covering said pressure sensitive adhesive and adapted to be separable from said tag to expose said pressure sensitive adhesive, said tag having a wicket providing portion formed by a portion of said tag, said wicket providing portion having a reinforcing tape adhered to the surface thereof opposite the pressure sensitive adhesive coated surface thereof.

2. A ticket according to claim 1 wherein said wicket providing portion is strip portion formed by a slit in the tag.

3. A ticket according to claim 2 wherein said slit is straight and it spaced from and extends along a side edge of said tag.

4. A ticket according to claim 3 wherein said slit extends along the entire length of said side edge so that said strip portion is separable from the remaining portion of said tag for use as a wicket.

5. A ticket according to claim 1 wherein said wicket providing portion is formed by a pop-out portion defined by a cut in said tag enclosing said pop-out portion.

6. A strip of self-wicketing tickets arranged in end-to end relation wherein each of said tickets is comprised of:

a tag portion having one surface coated with a pressure sensitive adhesive and a backing covering said pressure sensitive adhesive, said tag portion having a wicket providing means formed by a strip portion thereof, said strip portion having a reinforcing tape adhered to the surface thereof opposite the coated surface for strengthening the strip portion.

7. A ticket strip according to claim 6 wherein the strip portion of each of said tickets is formed by a slit in said tag portion spaced from and extending along a side edge of said tag portion and longitudinally of said strip of tickets, the slits of each strip portion being aligned.

* * * * *